US005199710A

United States Patent [19]

Lamle

[11] Patent Number: 5,199,710

[45] Date of Patent: Apr. 6, 1993

[54] METHOD AND APPARATUS FOR SUPPLYING PLAYING CARDS AT RANDOM TO THE CASINO TABLE

[76] Inventor: Stewart Lamle, 3 Fordham Hill Oval, Suite 15F, New York, N.Y. 10468

[21] Appl. No.: 816,300

[22] Filed: Dec. 27, 1991

[51] Int. Cl.[5] ..... A63F 1/14

[52] U.S. Cl. ..... 273/149 R; 273/138 A; 273/309

[58] Field of Search ..... 273/138 A, 139, 449 P, 273/149 R, 85 CP; 283/903, 49

[56] References Cited

U.S. PATENT DOCUMENTS

| | | | |
|---|---|---|---|
| 4,373,726 | 2/1983 | Churchill et al. | 273/138 A |
| 4,725,079 | 2/1988 | Koza et al. | 283/903 |
| 4,832,341 | 5/1989 | Muller et al. | 273/138 A |
| 4,995,615 | 2/1991 | Cheng | 273/85 CP |

*Primary Examiner*—Benjamin H. Layno

*Attorney, Agent, or Firm*—Robert W. J. Usher

[57] ABSTRACT

Playing cards are supplied into play at a playing area while a card game is in progress and whenever required by the rules of the card game and only for immediate use by players by successively generating signals representing indicia designating respective single, individual playing card values randomly drawn from a series of stored playing card values while the game is in progress, feeding the signals to a card stock printer at the playing area and immediately delivering single, leading printed playing cards successively, one-by-one into play. A gaming table has a part circular playing top area with a dealing station having a chip tray located adjacent the center and a series of circumferentially arranged betting stations. A printer and a card stock store are mounted on an undersurface of the table adjacent the dealing station and the card delivery means includes a card delivery slot extending through the table to the playing area.

13 Claims, 1 Drawing Sheet

METHOD AND APPARATUS FOR SUPPLYING PLAYING CARDS AT RANDOM TO THE CASINO TABLE

FIELD OF THE INVENTION

Figure 1:
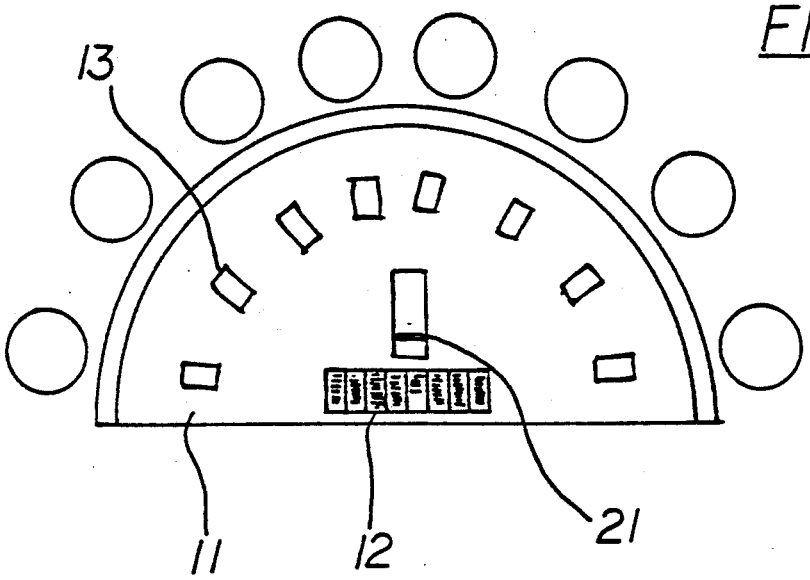

The invention relates to a method and apparatus for supplying playing cards at random to a casino table.

BACKGROUND OF THE INVENTION

Traditionally, playing cards have been supplied to a playing area or table in a casino by dealing from one or more shuffled decks of pre-printed cards. Although, in dependence on the thoroughness of the shuffle, initial cards are dealt from an almost complete pack with a fairly high degree of randomness, as the pack is of finite length, in practice the cards remaining available for dealing, decrease with each card dealt and, therefore, the randomness rapidly decreases, with the probability of any particular card being dealt progressively increasing to a much higher value than the probability prevailing with a fresh deck. Although casino operators deal from multiple decks and split the decks so that a substantial proportion of cards having undetected values cannot be dealt at that session, "card counting" remains a problem as significant swings in probability against the house are still detectable by the card counter.

As the payout of the game is usually calculated on a random basis assuming a full deck of cards, variations in amounts wagered following such card counting can result in the odds actually swinging substantially against the casino and the casino consequently loosing substantial sums of money.

In addition, considerable time and money can be spent on monitoring "card counters". Furthermore, the time needed to shuffle effectively several decks causes an undesirably costly hiatus in play with many players leaving the table during the shuffle, not to return. Considerable supplies of cards must also be kept in a safe while a watch must also be maintained for any marked recirculating cards.

SUMMARY OF THE INVENTION

It is an object of the invention to deliver playing cards to the table in a random fashion without a requirement for shuffling.

It is another object of the invention to avoid the requirement for keeping stocks of unused playing cards and for recirculating playing cards.

It is an additional object of the invention to enable the probability of a dealt card having any particular value to be varied thereby simulating dealing from any particular deck or decks of any predetermined finite size.

According to one aspect of the invention, there is provided a method of supplying playing cards to a casino table in which randomly generated indicia denoting card values are printed on successive leading individual portions of card stock only at the time of delivery of the card to the table.

Thus the prior requirement to shuffle cards is obviated, the cards being discarded after use, while a truly random distribution of the cards actually dealt can be obtained irrespective of the cards previously dealt, if desired, simulating a deck of infinite length.

More specifically, the invention includes a method of supplying playing cards to a playing area comprising the steps of providing a store of card stock and a card stock printing means at the playing area, storing data of a series of possible card values in a memory, successively generating signals representing indicia designating respective card values randomly drawn from the series of stored card values and feeding the signals successively to the printing means, operating the printing means to print stock forming successive leading cards with a respective indicia corresponding with the signals received and delivering the printed leading cards successively to the playing area.

If desired, the invention includes feeding randomly generated signals representing only values of cards which have not been previously delivered thereby simulating dealing from one or more decks of finite length.

The distribution of the cards delivered can then be tailored to simulate an actual situation in which one or more pre-printed packs are used for dealing and split as necessary.

The card stock may also be provided in the form of a continuous strip with successive leading cards being severed from a leading end thereof, one-by-one.

Different indicia denoting different values may be printed on respective opposite faces of the cards to provide a double sided playing card increasing the variety of games to be played.

According to another aspect of the invention, apparatus for supplying playing cards to a casino table comprises:

means for storing a supply of card stock at the table;

memory means for storing data representing a series of possible card values;

means for generating a signal representing a card value randomly drawn from the series;

printing means at the table and connected to the generating means for printing an indicia on the card stock designating the value of the card in response to a signal received from the signal generating means;

stock feeding means for feeding stock forming an individual leading card from the supply to the printing means; and, card delivering means connected between the printing means and the table for delivering the printed card so formed to the table.

Advantageously, the apparatus may include a processing unit in which the generating means is a random number generator and memory means for recording card values generated previously by the random number generator or delivered for reducing the range of possible values generated accordingly.

Furthermore, the printing means may include means for printing different indicia on respective opposite faces of the card stock and in which the random number generator successive random values for printing on respective opposite faces of the card stock.

BRIEF INTRODUCTION TO THE DRAWINGS

Figure 2:
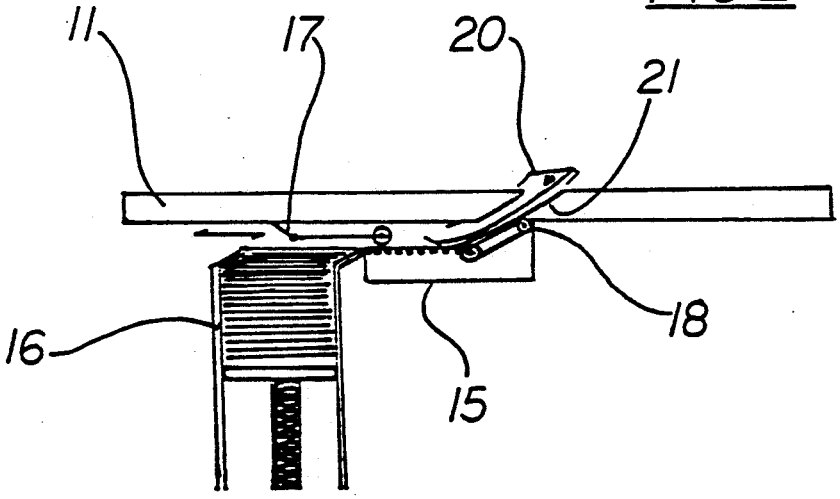

A specific embodiment of the invention will now be described by way of example only and with reference to the accompanying drawings in which:

FIG. 1 is a schematic plan view of a casino gaming table incorporating the invention; and, FIG. 2 is a schematic side elevation showing a table section incorporating the invention.

As shown in the drawings, a casino gaming table 11 has a semi-circular (or kidney shape) playing top area with a dealing station having a chip tray 12 located adjacent the center and a series of circumferencially arranged betting stations 13 for receiving players chips.

A color printer 15 (e.g. inkjet or laser) is mounted on an undersurface of the table adjacent the dealing station and a separate card stock store 16 is mounted adjacent an input end thereof with a reciprocating arm friction roller feed mechanism 17 of conventional design mounted to separate and feed leading pieces of cards stock one-by-one from the store 16 to the printer.

A roller driven belt 18 is located at the outlet end of the printer for delivering printed cards through a card delivery slot 21 cut in the table, to the playing area.

A central processing unit (CPU not shown) includes a random number generator having an output connected through the printer. The CPU can store in memory data of a series of possible card values for desired games and is programmed to generate random signals representing selected of those card values without regard to previously generated signals thereby simulating a deck of infinite length. Alternatively, the range of values may correspond to a deck of finite length, or to a plurality of such decks having predetermined numbers of cards. In one version, the CPU can store in memory a record of previously selected and printed card values, remove such values from the stored series available so that only previously unselected card values can be delivered to the printer thereby simulating dealing from one or more decks of finite length, the card values remaining for selection corresponding only to those remaining in a deck from which known cards have been dealt.

When all bets have been placed, the dealer operates a suitable switch (not shown) to initiate the random number generation and to actuate the roller feed to feed only a leading piece of card stock to the printer. The printer prints an indicia on the face of the card stock corresponding to the signal received from the CPU and the card is immediately delivered through the delivery slot by the delivery belt onto the table surface.

Thus, a deck of any length can be simulated or, one of infinite length, if the problem of card counting is to be avoided. In addition, the problems of delays of shuffling and imperfect shuffling and recirculation of dealt cards is completely obviated.

In one embodiment, the card stock may be a continuous strip of stiff paper supplied in roll form or in zig-zag folds and the leading card stock can be separated by severing therefrom before or after printing.

The card stock can be contained in the printer housing, contemporary printers having cassettes accommodating large numbers of sheets. The cassette may be changed at the end of each dealers shift.

In one embodiment, the printer is double-headed for printing indicia on respective opposite faces of the card stock and the CPU is programmed to generate two sets of randomly generated indicia successively.

I claim:

1. A method of supplying playing cards into play at a playing area while a card game is in progress for immediate use by players during said card game comprising the steps of providing a store of playing card stock and a playing card stock printing means at the playing area, storing data of a series of possible playing card values in a memory, successively generating signals representing indicia designating respective single, individual playing card values randomly drawn from the series of stored playing card values while the game is in progress; and feeding the signals successively to the printing means whenever playing cards are required for immediate use by players according to the rules of the game, operating the printing means to print stock forming successive single, individual leading playing cards with a respective indicia corresponding with the signals received and immediately delivering the single, individual printed leading playing cards successively, one-by-one into play at the playing area while the game is in progress.

2. A method according to claim 1 including the step of successively removing from the stored data series of possible playing card values, playing card values previously drawn and sent to the printing means, thereby simulating at least one deck of playing cards of finite length.

3. A method according to claim 1 including the step of printing indicia designating different single, individual playing card values on opposite faces of the leading playing card stock forming the single individual playing card.

4. A method according to claim 1 including the step of providing the playing card stock in a continuous strip and separating leading playing card stock forming the single individual playing card therefrom by severing the strip.

5. A method of supplying playing cards into play during a card game to a card table having a playing area while a card game is in progress for immediate use by players comprising the steps of providing a store of playing card stock and playing card printing means at the table, storing data of a series of playing card values, generating a random signal representing a single individual playing card value drawn from the series of playing card values while the game is in progress and feeding the signal to the printing means whenever an individual playing card is required for immediate use by a player according to the rules of the game, separating and printing stock forming a leading single, individual playing card from the store with indicia corresponding to the received signal and delivering the printed single, individual playing card into use at the playing area of the table immediately thereafter while the game is in progress.

6. A method according to claim 5 including the step of recording data of values of previously delivered playing cards and feeding to the printing means only randomly generated signals representing indicia of playing cards remaining thereby simulating drawing playing cards from a deck of finite length.

7. A method according to claim 5 including the step of printing indicia designating different single, individual playing values on opposite faces of the leading single individual playing card stock.

8. Apparatus for supplying playing cards to a gaming table which has a part circular playing top area with a dealing station having a chip tray located adjacent the center and a series of circumferencially arranged betting stations for receiving player's chips, during a card game comprising:

means for storing a supply of playing card stock at the table;

memory means for storing data representing a series of possible playing card values;

means for generating a signal representing a single, individual playing card value randomly drawn from the series while the game is in progress;

printing means at the table and connected to the generating means for printing an indicia on the playing card stock designating the value of the single, individual playing card in response to a signal received from the signal generating means;

playing card stock feeding means for feeding playing card stock forming a single individual leading playing card from the supply to the printing means; and, playing card delivering means connected between the printing means and the table for delivering the single individual printed playing card so formed to the table while the game is in progress.

9. Apparatus according to claim 8 including means for removing from the data store of possible playing card values data, playing card values previously generated thereby simulating a playing card deck of finite length.

10. Apparatus according to claim 8 in which the printing means includes means for printing different indicia on respective opposite faces of the playing card stock and in which the signal generating means generates successive random values for printing on respective opposite faces of the playing card stock.

11. Apparatus according to claim 8 in which the signal generating means includes a random number generator.

12. Apparatus according to claim 8 in which the playing card stock is a continuous strip and severing means are provided for separating stock forming a leading playing card from the strip.

13. Apparatus according to claim 8 in which the printing means and storing means are mounted on an undersurface of the table adjacent the dealing station and the card delivery means includes a card delivery slot extending through the table, to the playing area.

* * * * *